US006145934A

United States Patent [19]

Arai et al.

[11] Patent Number: 6,145,934

[45] Date of Patent: Nov. 14, 2000

[54] DISCHARGE DESTROYING METHOD, DISCHARGE DESTROYING DEVICE AND METHOD OF MANUFACTURING THE SAME

[75] Inventors: Hiroaki Arai, Osaka; Hidehiko Maehata, Suita; Tetsuya Inoue, Osaka; Tsuyoshi Kato, Takatsuki; Hiroyuki Daiku, Kawachinagano, all of Japan

[73] Assignee: Hitachi Zosen Corporation, Japan

[21] Appl. No.: 09/000,130

[22] PCT Filed: Jul. 22, 1996

[86] PCT No.: PCT/JP96/02060

§ 371 Date: Jan. 23, 1998

§ 102(e) Date: Jan. 23, 1998

[87] PCT Pub. No.: WO97/03796

PCT Pub. Date: Feb. 6, 1997

[30] Foreign Application Priority Data

| | | | |
|---|---|---|---|
| Jul. 24, 1995 | [JP] | Japan | 7-186100 |
| Jul. 28, 1995 | [JP] | Japan | 7-192342 |
| Jul. 31, 1995 | [JP] | Japan | 7-193963 |

[51] Int. Cl.[7] ..... E21C 37/06; E21C 37/10

[52] U.S. Cl. ..... 299/21; 299/16; 299/20

[58] Field of Search ..... 299/14, 16, 20, 299/21; 102/333, 302, 312, 313; 166/177.5

[56] References Cited

FOREIGN PATENT DOCUMENTS

| | | | |
|---|---|---|---|
| 0002140 | 1/1980 | Japan | 299/16 |
| 59-185294 | 10/1984 | Japan . | |
| 63-150600 | 6/1988 | Japan . | |
| 0190893 | 7/1989 | Japan | 299/21 |
| 7-145698 | 6/1995 | Japan . | |

*Primary Examiner*—Eileen Dunn Lillis
*Assistant Examiner*—Suuil Singh
*Attorney, Agent, or Firm*—D. Peter Hochberg; William H. Holt

[57] ABSTRACT

A method comprising a step to form a hole (2) for charging a breaking substance (4) into an object to be fractured (1), a step to insert a pair of electrodes (6) having a thin metal wire (5) connected between ends thereof into the hole (2), a step to dispose the breaking substance (4) and the thin metal wire (5) into a bag-like container (22) made of rubber at a stage to supply electric energy accumulated in a capacitor to the electrodes (6) for fusing and vaporizing the thin metal wire (5), thereby swelling a volume of the breaking substance (4) and breaking the object to be fractured (1), and a step to fit the bag-like container (22) into the hole (2). This method assures secure transmission of an expansion force to the object to be fractured even when the hole formed in the object to be fractured is deformed.

6 Claims, 17 Drawing Sheets

DISCHARGE DESTROYING METHOD, DISCHARGE DESTROYING DEVICE AND METHOD OF MANUFACTURING THE SAME

TECHNICAL FIELD

The present invention relates to an electric discharge breaking method and system which are used for destruction of base rocks and breakage of rocks, and a method for manufacturing the discharge breaking system.

BACKGROUND ART

As a system for destroying an object to be ruptured, for example, a base rock, there is known a discharge breaking system which is shown in FIG. 22.

This discharge breaking system 101 is composed of a cylindrical container 103 which is made of synthetic resin, glass or the similar material and is to be filled with a breaking substance (referred to also as a substance for transmitting a pressure, for example, water 102), a pair of electrodes 104 which pass through a stopper 103*a* into the cylindrical container 103, a thin metal wire 105 which is disposed between these electrodes 104 and made of copper or aluminum, a capacitor 107 which is connected between these electrodes 104 through discharging electric wires 106, and a direct current power supply (power supply unit) 109 which is connected to the capacitor 107 through charging electric wires 108.

Needless to say, a discharging switch such as a thyristor is interposed in the course of the discharging electric wires 106 and a charging control circuit 111 comprising a charging switch is interposed in the course of the charging electric wires 108.

For carrying out shock fracture by electric discharge (hereinafter referred to as discharge breaking), an electrode fitting hole 122 is formed at a definite location of an object to be fractured, for example, a base rock 121, the cylindrical container 103 is fitted, together with the electrodes 104 and thin metal wire 105 disposed therein, into the electrode fitting hole 122 and the discharging switch 110 is turned on to flow, or discharge, electric energy charged in the capacitor 107 at a stroke to the thin metal wire 105, thereby fusing and vaporizing the thin metal wire 105. Then, water is also evaporated or vaporized in a moment and the base rock 121 is fractured by a breaking force generated by volumetric swelling, i.e., expansion force.

However, the discharge breaking system described above, in which the cylindrical container 103 filled with water 102 used as the breaking substance is fitted in the hole 122, may be incapable, in some cases, of sufficiently transmitting the expansion force and allows it to leak through an opening of the hole 122 since the cylindrical container 103 has a form which is not always coincident with that of the hole 122, or the hole 122 is usually formed larger than the cylindrical container 103, thereby forming a gap a.

Even when the expansion force does not leak through the opening between the cylindrical container 103 and the hole 122, this discharge breaking system poses a problem that the stopper 103*a* which has a weak sealing force is blown out, thereby allowing the generated expansion force to escape outside (to a side of the free surface).

Further, the thin metal wire 105 which is simply disposed between the pair of the electrodes 104 are ineffective for controlling an expansion force to be generated.

It is therefore a primary object to provide a discharge breaking method, a discharge breaking system and a manufacturing method for the discharge breaking system capable of sufficiently transmitting an expansion force (breaking force) and controlling this expansion force.

DISCLOSURE OF THE INVENTION

A first breaking method according to the present invention comprises a step to form a hole for charging a breaking substance in an object to be fractured, a step to insert a pair of electrodes having a thin metal wire connected between ends thereof into the hole, a step to dispose and subsequently seal the breaking substance and at least the thin metal wire in a container at a stage to destroy the object to be fractured by supplying electric energy charged in a capacitor to the electrodes for fusing and vaporizing the breaking substance, and a step to close an opening of the hole.

Further, a first discharge breaking system according to the present invention is a system comprising a pair of electrodes which have a thin metal wire connected between ends thereof and are fitted in a hole formed in an object to be fractured and to be charged with a breaking substance, a capacitor connected to these electrodes, a power supply unit for supplying electricity to this capacitor, a charging control circuit which is interposed in the course of charging electric wires between the power supply unit and the capacitor, a discharging switch which is interposed in the course of discharging electric wires between the pair of electrodes and the capacitor, wherein the breaking substance to be charged in the hole is filled in and subsequently sealed by a sealing stopper in a container which is configured to accommodate the thin metal wire connected between the ends of the electrodes and the system has a member to close an opening of the hole after the container is fitted into the hole for carrying out a discharge breaking work.

The discharge breaking method and the discharge breaking system described above which are configured to close a space over the container fitted in the hole formed in the object to be fractured, or the opening of the hole, makes it possible to prevent the expansion force of the breaking substance from escaping out through the opening of the hole, thereby strengthening the expansion force, or enhancing a breaking efficiency.

A second discharge breaking method according to the present invention comprises a step to form a hole for charging a breaking substance in an object to be fractured, a step to insert a pair of electrodes having a thin metal wire connected between ends thereof into this hole, a step to dispose the breaking substance and at least the thin metal wire in an elastic bag-like container at a stage to destroy the object to be fractured by supplying electric energy charged in a capacitor to these electrodes for fusing and evaporating the thin metal wire, and a step to fit the elastic bag-like container into the hole.

A third discharge breaking method according to the present invention comprises a step to close an opening of the hole in addition to the steps of the second discharge breaking method.

A second discharge breaking system according to the present invention is a system comprising a pair of electrodes which have a thin metal wire connected between ends thereof and are fitted into a hole formed in an object to be fractured and filled with a breaking substance, a capacitor connected to these electrodes, a power supply unit for supplying electricity to this capacitor, a charging control circuit interposed in the course of electric wires between the power supply unit and the capacitor, and a discharging switch interposed in the course of a discharging electric wires between the pair of electrodes and the capacitor, wherein the breaking substance to be filled in the hole is charged in an elastic bag-like container which is configured to accommodate the thin metal wire connected between lower ends of the electrodes.

The second discharge breaking method, the third discharge breaking method and the second discharge breaking system which use the bag-like containers having elasticity as the containers to be charged with the breaking substance allow the bag-like containers to be brought into contact with inside wall surfaces of the hole formed in the objects to be fractured even when the holes are deformed, thereby assuring secure transmission of expansion forces and enabling to enhance breaking efficiencies.

A third discharge breaking system according to the present invention comprises a pair of electrodes which have a thin metal wire connected between ends thereof and are to be fitted into a hole formed in an object to be fractured for charging a breaking substance, a capacitor connected to these electrodes, a power supply unit for supplying electricity to this capacitor, a charging control circuit interposed in the course of charging electric wires between the power supply unit and the capacitor, and a discharging switch interposed in the course of discharging electric wires between the pair of electrodes and the capacitor, wherein lower ends of the pair of electrodes are disposed substantially at a same horizontal level and the thin metal wire connected between the lower ends of the electrodes is curved substantially in a same plane.

A fourth discharge breaking system according to the present invention is a one wherein the thin metal wire used in the third discharge breaking system described above has a U shape, a W shape or a corrugated shape.

A fifth discharge breaking system according to the present invention is a one wherein the thin metal wire used in the third or fourth discharge breaking system has a shape which is selected to satisfy relationship of $0.25 \leqq X/Y$ where the reference symbol X represents a height or a distance in the vertical direction and the reference symbol Y designates a width or a distance in the horizontal direction as shown in FIG. 8.

The third through fifth discharge breaking systems which are configured to select the curved shapes for the thin metal wires connected between the electrodes are capable of enhancing breaking pressures since regions subject to functions of expansion forces generated by electric discharge are narrowed when the curved thin metal wires are connected in place of straight thin metal wires between the electrodes.

A sixth discharge breaking system according to the present invention is a one comprising a container which contains a thin metal wire connected between a pair of electrodes and a breaking substance, and is to be fitted into a hole formed in an object to be fractured, a capacitor connected to the electrodes, a power supply unit for supplying electricity to this capacitor, a charging control circuit interposed in the course of a charging electric wires between the power supply unit and the capacitor, and a discharging switch interposed in the course of discharging electric wires between the pair of electrodes and the capacitor, wherein breaking openings are formed in a side wall of the container for leading an expansion force generated by melting and vaporizing the breaking substance outward in prescribed directions.

A seventh discharge breaking system according to the present invention is configured to use a fluidized self-hardening substance as the breaking substance in the sixth discharge breaking system.

A first method for manufacturing a discharge breaking system according to the present invention is configured to manufacture the sixth discharge breaking system described above, and comprises a step to charge a fluidized self-hardening substance into the container after closing the breaking openings of the container with a sheath member and another step to peel off the sheath member after the self-hardening substance is solidified.

A second method for manufacturing a discharge breaking system according to the present invention is configured to manufacture the sixth discharge breaking system described above and comprises a step to submerge a container into a fluidized self-hardening substance for filling the container with the self-hardening substance and another step to pull out the container from the self-hardening substance after this substance is solidified.

The sixth discharge breaking system, the seventh discharge breaking system, the first manufacturing method for the discharge breaking system and the second manufacturing method for discharge breaking system permit carrying out discharge breaking works with high efficiencies since expansion forces are led to the breaking openings formed in the containers.

BEST MODE FOR CARRYING OUT THE INVENTION

Figure 1:
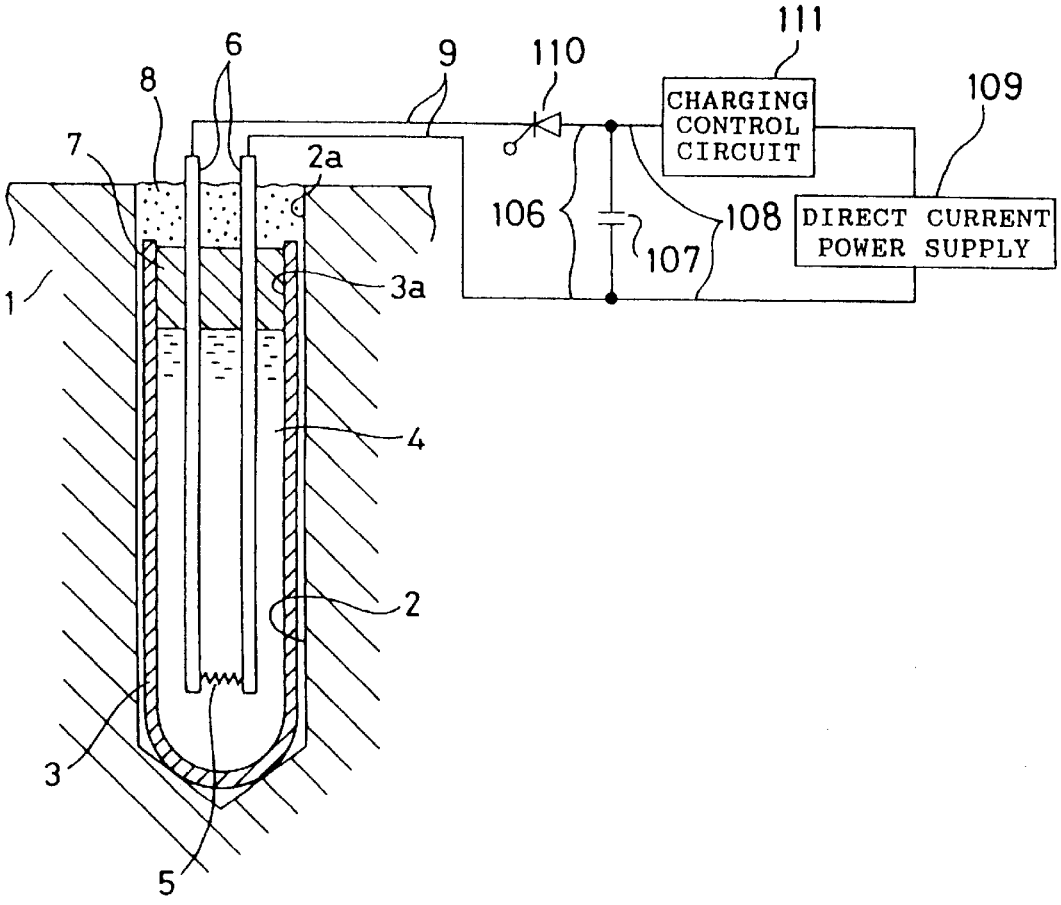
FIG. 1 is a sectional view illustrating an overall configuration of a first embodiment of the discharge breaking system according to the present invention.

Now, a first embodiment of the present invention will be described with reference to the accompanying drawings.

Since the present invention relates essentially to a container which is to be filled with a breaking substance and contains electrodes, description will be made mainly of this member. An electric circuit used for applying electric energy between the electrodes remains unchanged from that which has been described with reference to the conventional example, and members thereof will be represented by the reference numerals used in the description of the conventional example and not explained in particular (this description manner will apply to second and third embodiments).

A breaking substance 4 (referred to also as a substance for transmitting a pressure, for example, water, oil or a gel-like substance such as a jelly) and a pair of electrodes 6 having a thin metal wire 5 which is made of copper or aluminum and connected between ends thereof are placed, as shown in FIG. 1, in a cylindrical container (made of a relatively hard material such as synthetic resin or glass) 3 which is to be fitted into a hole 2 formed in an object to be fractured (for example, a base rock or a concrete building) 1.

A stopper 7 for enclosing the breaking substance 4 is fitted in an opening 3*a* of the cylindrical container 3 containing the electrodes 6 and the thin metal wire 5. For closing an opening 2*a* of a hole 2, a closing member 8 such as sand is filled in the opening 2*a* of the hole 2 in which the cylindrical container is fitted.

When electric energy is supplied to the pair of electrodes 6 from a capacitor (not shown) through electric wires 9 in the configuration described above, the metal wire 5 is fused and evaporated in a moment, and accordingly water is vaporized in a moment and volumetrically swollen, thereby destroying the object to be fractured 1.

Since the opening 3*a* of the cylindrical container and the opening 2*a* of the hole 2 are closed powerfully with the sealing stopper 7 and the closing member 8 respectively as described above, these members can strengthen an expansion force generated by discharge breaking unlike a cover which is used simply for preventing a breaking substance from leaking out of a container.

A second embodiment of the present invention will be described with reference to the drawing.

Figure 2:
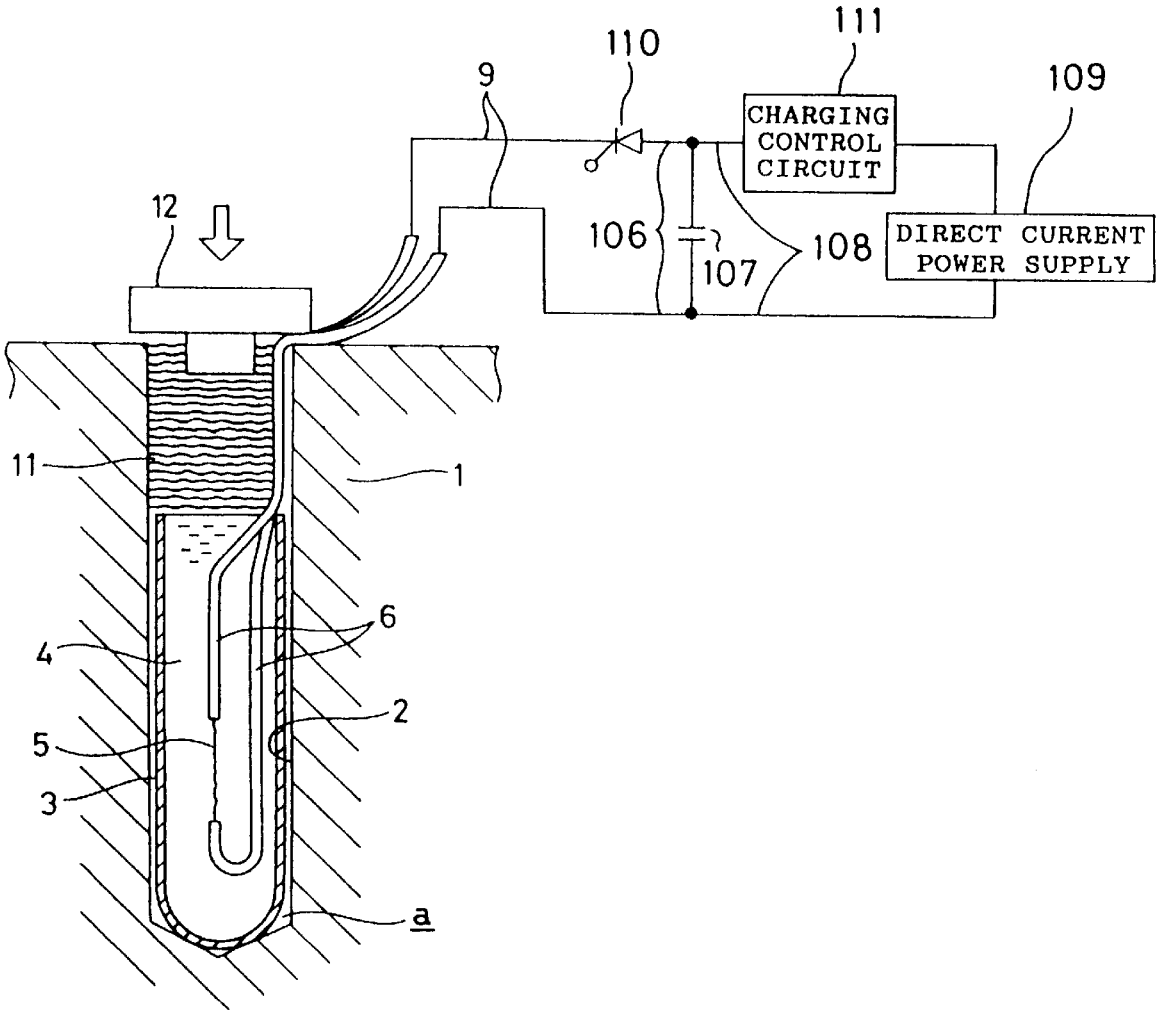
FIG. 2 is a sectional view illustrating an overall configuration of a second embodiment of the discharge breaking system according to the present invention.

In the second embodiment, a breaking substance 4, water for example, is filled in a cylindrical container 3 which is made of synthetic resin or glass and fitted in a hole 2 formed in an object to be fractured 1 as shown in FIG. 2, thereafter a fibrous member (referred to also as fibers and mentioned as an example of the closing member) 11 which is made of paper or cloth and impregnated with water being pushed in a condition of laminated layers and a metal stopper 12 being tapped thereon into a cylindrical container 3.

When the metal stopper 12 is tapped into the hole 2, the water soaking the fiber member 11 penetrates into a gap remaining between the cylindrical container 3 and the hole 2, whereby the gap 2 is filled with the water.

Figure 3:
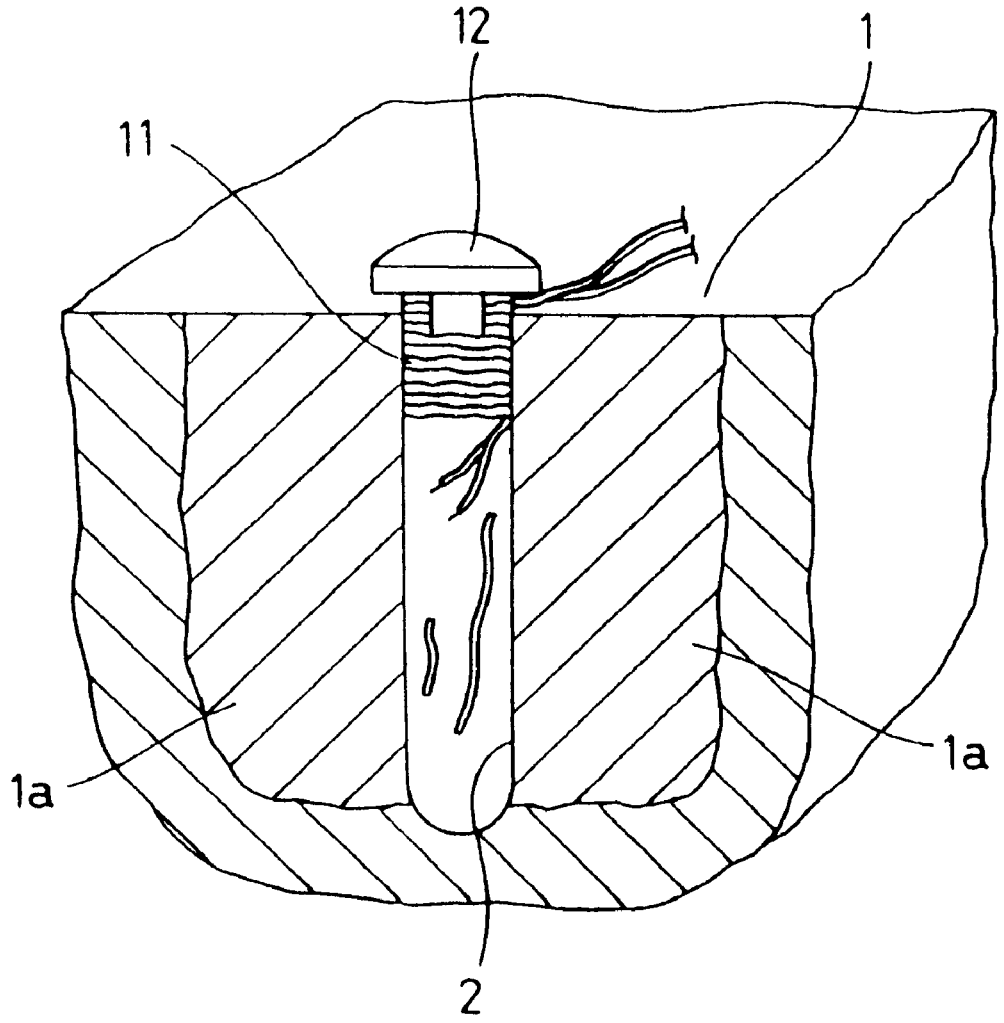
FIG. 3 is a perspective view illustrating a condition at a time of a discharge breaking in the second embodiment of the present invention.
Figure 4:
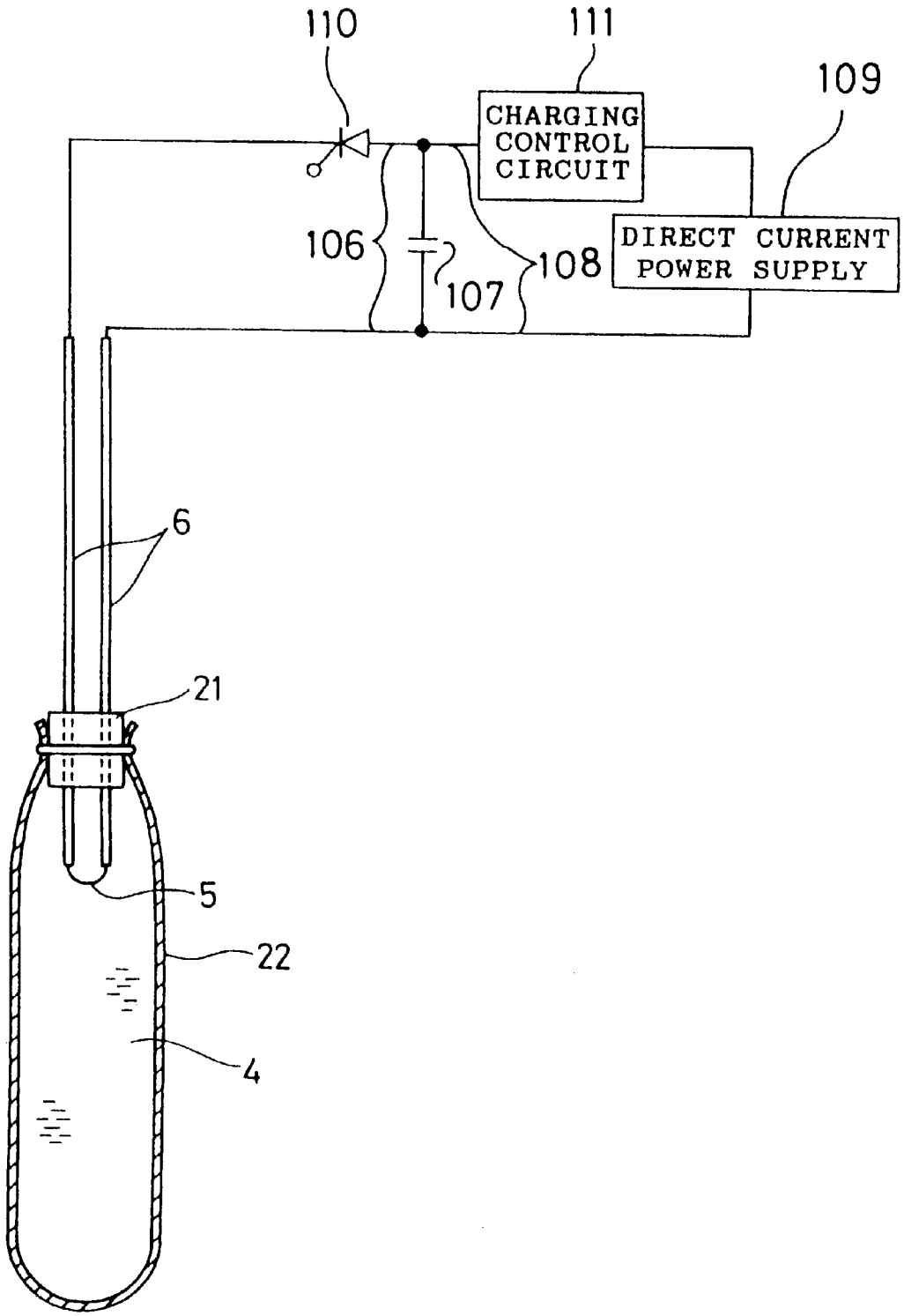
FIG. 4 is a sectional view illustrating an overall configuration of a third embodiment of the discharge breaking system according to the present invention.
Figure 5:
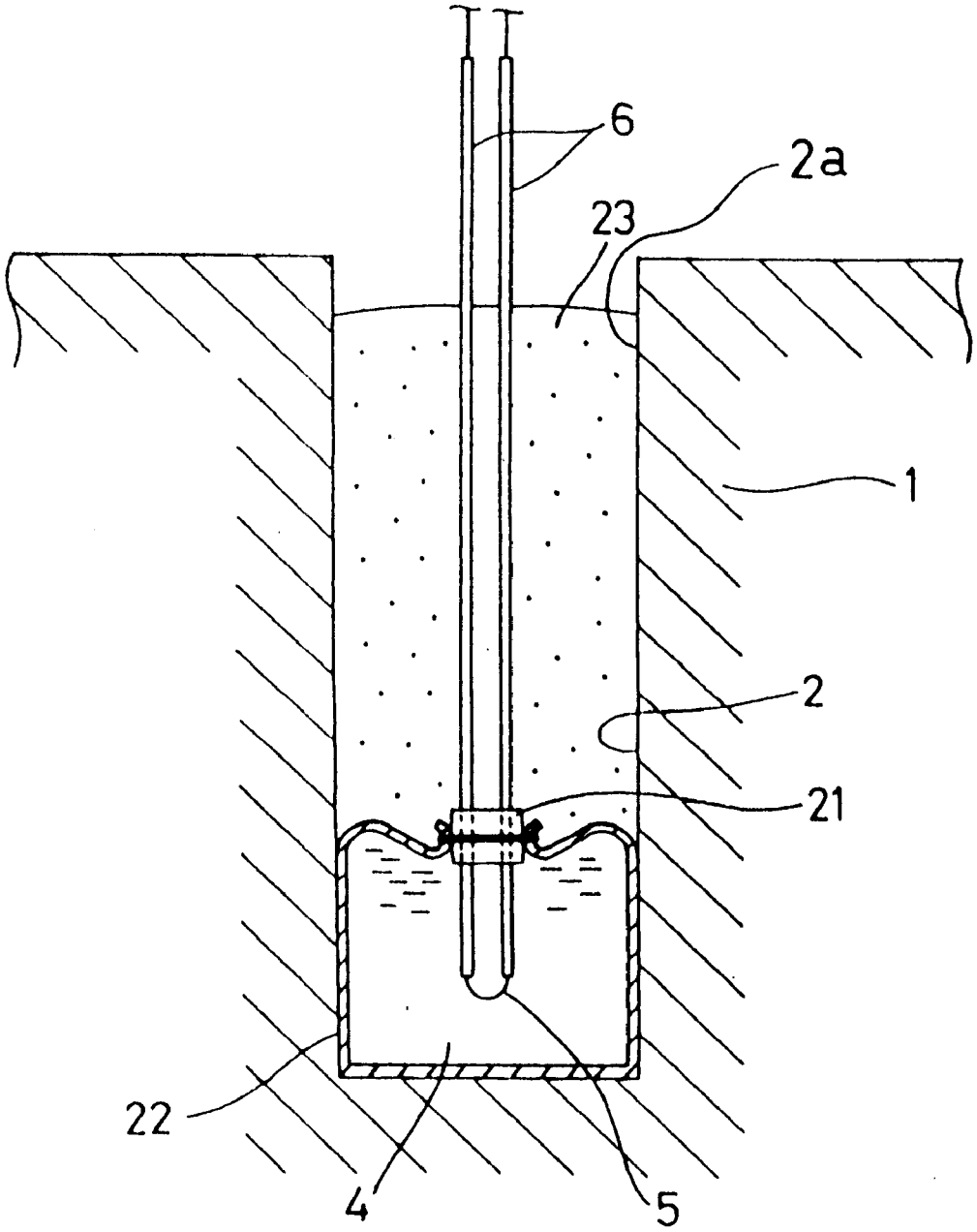
FIG. 5 is a sectional view illustrating a set condition of the third embodiment of the discharge breaking system.
Figure 6:
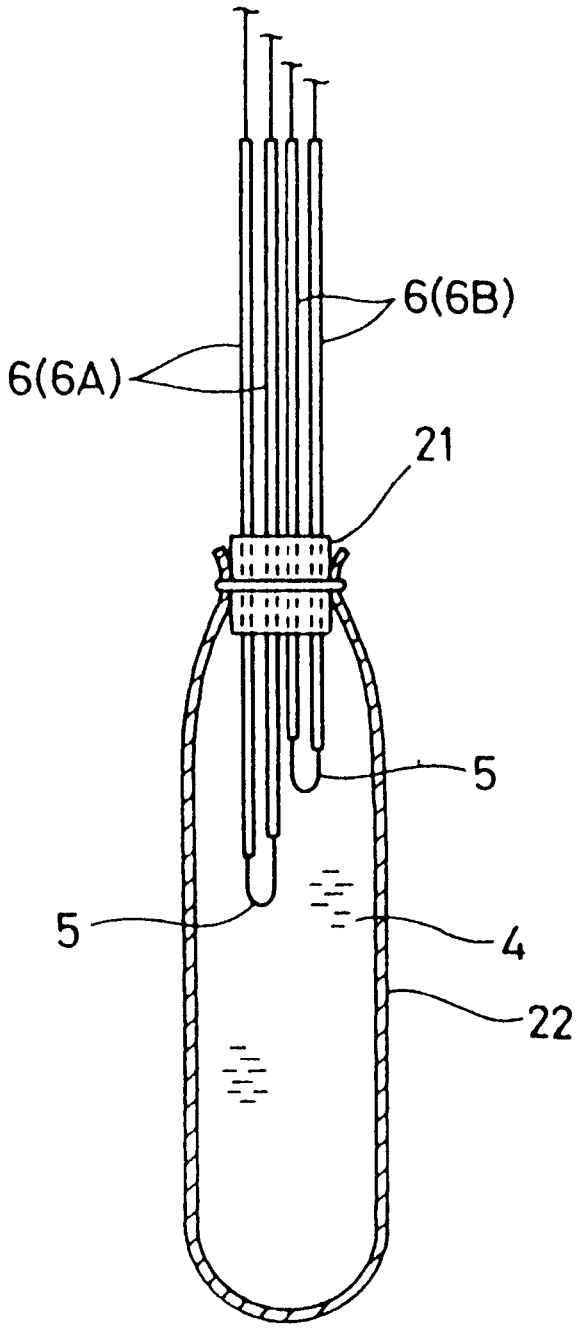
FIG. 6 is a sectional view illustrating main members in a modification of the third embodiment of the discharge breaking system.

Accordingly, the second embodiment allows no gap or an empty space to remain between the cylindrical container 3 and the hole 2, thereby assuring secure transmission of an expansion force generated by discharge breaking to the object to be fractured 1. A condition after a discharge breaking is shown in FIG. 3 wherein a reference numeral la represents a region which is fractured directly.

A third embodiment of the present invention will be described with reference to the accompanying drawings.

Though the first and second embodiments are described on assumptions that the cylindrical containers are made of a relatively hard material such as synthetic resin or glass and have forms which are not deformable, the third embodiment uses a container made of an elastic material for filling a breaking material.

Speaking concretely, a bag-like container 22 which is made of rubber is suspended to a stopper 21 made of a material such as cork. Needless to say, a thin metal wire 5 is connected across ends of a pair of electrodes 6 which pass through the stopper 21 and water is filled as a breaking substance 4 in the bag-like container 22.

For carrying out a discharge breaking work, the electrodes 6 and the bag-like container 22 filled with water 4 are put into a hole 2, and then an opening 2*a* is closed by charging a closing member 23, for example, clay, on the bag-like container 22.

In this condition, electric energy is supplied from a capacitor between the electrodes 6 for fusing and evaporating the thin metal wire 5 and swelling a volume of water, thereby destroying an object to be fractured 1.

Since water used as the breaking substance 4 is filled in the bag-like container 22 which is made of the elastic material such as rubber for carrying out discharge breaking as described above, no gap remains between the container 22 and the hole 2 and, since the bag-like container 22 is pressed as a whole from above by the clay 23, the bag-like container 22 is brought into secure contact with an inside wall of the hole 2 even when the hole 2 is deformed, whereby an expansion force produced by electric discharge is transmitted as a breaking force directly to an object to be fractured 1.

Though the pair of electrodes are disposed in the bag-like container 22 in the third embodiment described above, it is possible to dispose a plurality of pairs of electrodes 6A and 6B in the single bag-like container 22. Needless to say, a plurality of pairs of electrodes 6 can be disposed also in the container 3 in the first or second embodiment.

Though rod-like electrodes are used in the first embodiment described above, electric wires may be used as electrodes as shown in FIG. 2 illustrating the second embodiment.

Though the hole 2 is formed in the vertical direction in the object to be fractured 1 in each of the first through third embodiments described above, the hole 2 may be formed in an optional direction, for example, in a horizontal direction or an oblique direction.

The first through third embodiments which are configured to close the spaces over the containers fitted in the holes formed in the objects to be fractured, or the openings of the holes, are capable of preventing expansion forces from escaping through the openings of the holes or strengthening the expansion forces, thereby enhancing breaking efficiencies.

Further, owing to the fact that the container which is to be filled with the breaking substance is configured as a bag-like container having elasticity, the bag-like container is brought into contact with the hole along the inside wall thereof even when the hole formed in the object to be fractured is deformed, and security of transmission of an expansion force and a breaking efficiency are enhanced as compared with those in a case where a gap remains between a container and a hole.

Then, description will be made of a fourth embodiment of the present invention with reference to FIGS. 7 through 11.

The fourth embodiment will be described also mainly on its electrodes. Its electric circuit for supplying electric energy between the electrodes remains unchanged from that described with reference to the conventional example and its members will be represented by the same reference numerals with no particular description.

Figure 7:
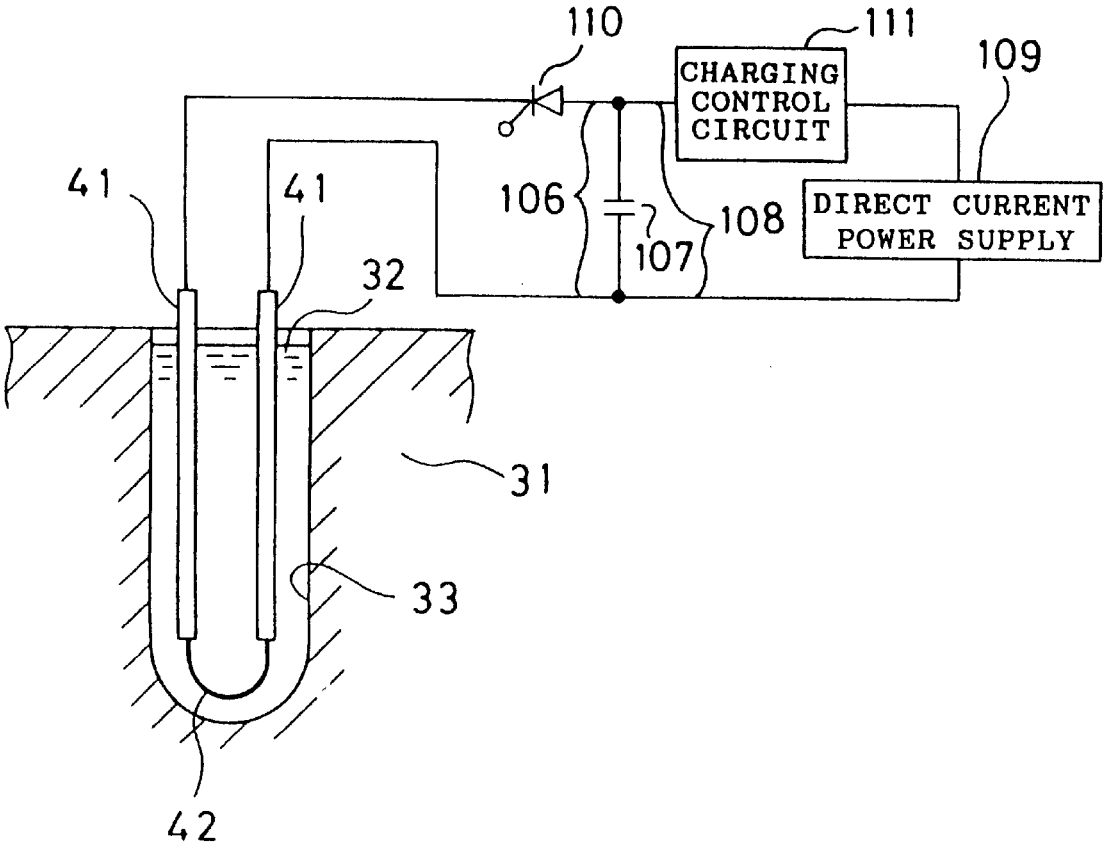
FIG. 7 is a sectional view illustrating an overall configuration of a fourth embodiment of the discharge breaking system according to the present invention.

A pair of electrodes 41 are inserted into a hole 33 which is formed in an object to be fractured (for example, a base rock or a concrete building) 31 and filled with a breaking substance (for example, water, oil or a gel-like substance) 32 as shown in FIG. 7.

Lower ends of these electrodes 41 are kept nearly at the same horizontal level and a thin metal wire 42 is connected in a U shape across the lower ends of the electrodes 41.

Figure 8:
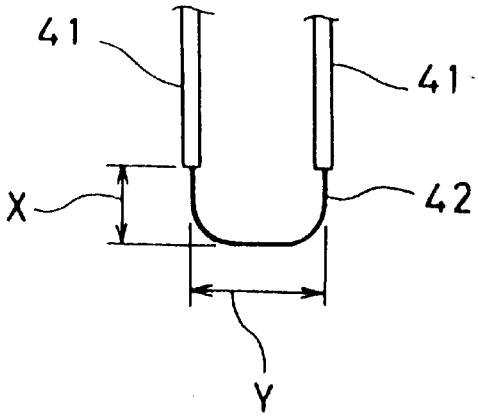
FIG. 8 is a front view illustrating main members of the fourth embodiment of the discharge breaking system.

When a minimum area (an area of a rectangle) (strictly speaking, a spatial volume) including the thin metal wire 42 on a vertical plane is considered as shown in FIG. 8, and a height of the minimum area (a projected height of the thin metal wire) is represented by X and its width (a projected width) is designated by Y; then X and Y are selected so as to have values satisfying the following equation (1):

$$0.25 \leqq X/Y \leqq 4 \quad (1)$$

Figure 9:
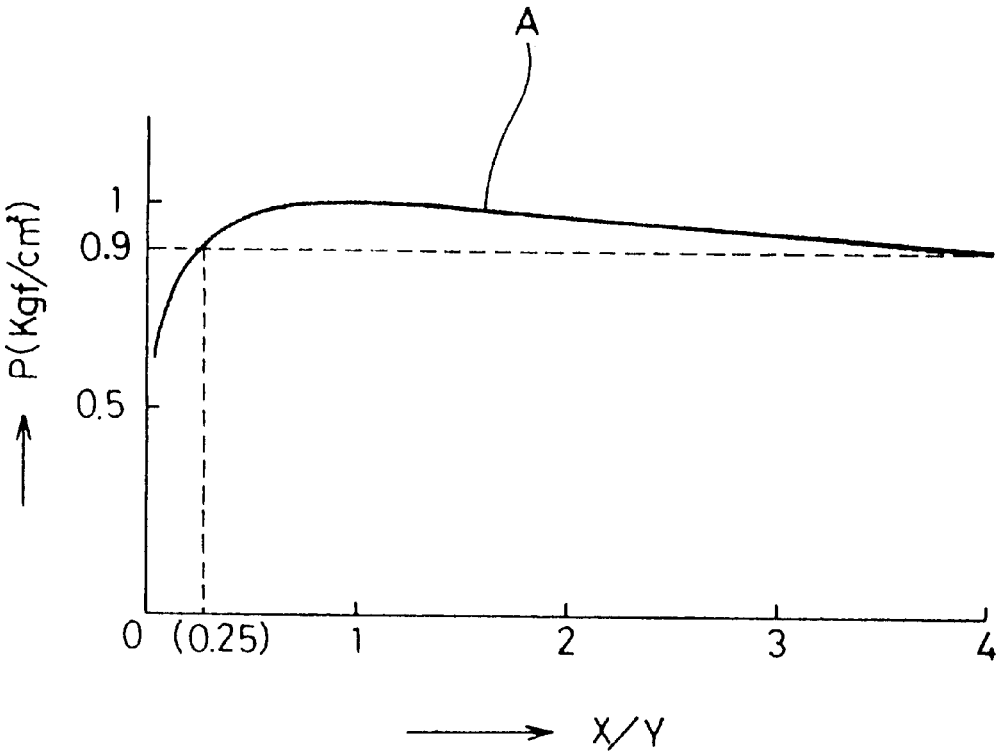
FIG. 9 is a graph illustrating relationship between sizes of thin metal wire and a breaking pressure in the fourth embodiment of the discharge breaking system.

The range defined by the above-mentioned equation (1) was adopted since examinations of relationship between a value of X/Y and a breaking pressure P (kg/cm$^2$) provided a curve A shown in FIG. 9, and X/Y was selected within a range wherein the breaking pressure was high (for example, $P \geqq 0.9$). A curve A shown in FIG. 9 was traced while a breaking pressure being normalized as unit at X/Y=1.

Figure 10A:
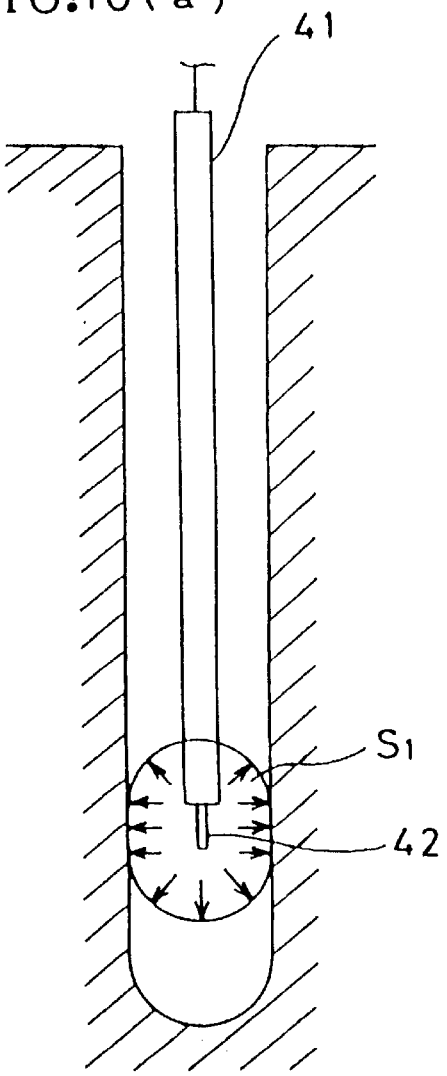
FIGS. 10(*a*) through 10(*c*) are side views illustrating regions to be subjected to breaking functions of the thin metal wire used in the fourth embodiment and another thin metal wire disposed in a direction perpendicular thereto.
Figure 10B:
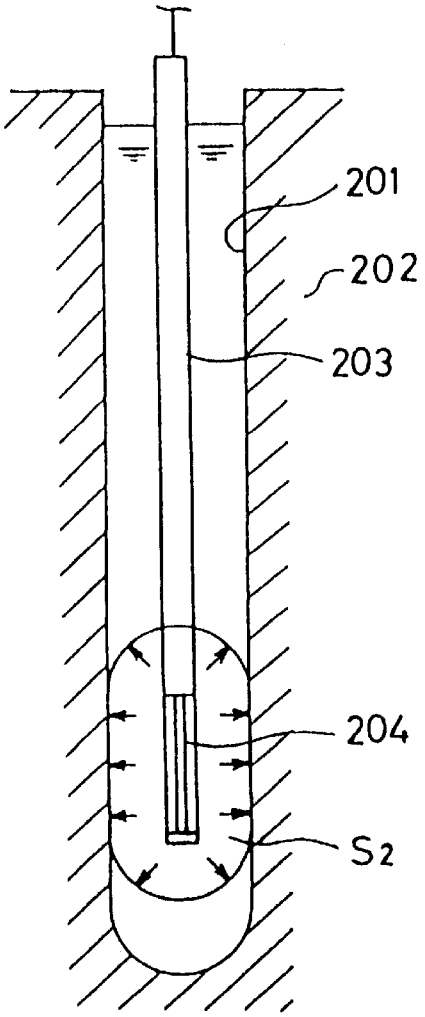
Figure 10C:
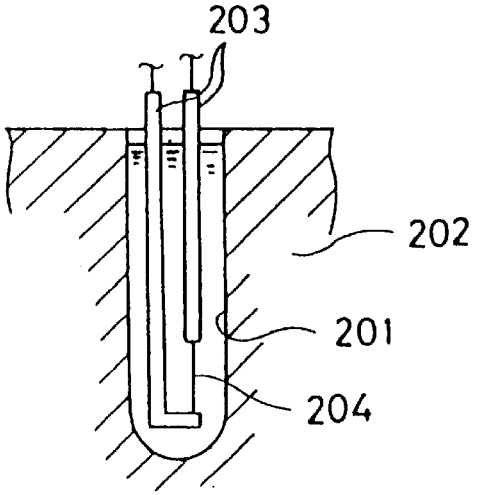

A breaking range obtained with the thin metal wire 42 used in the embodiment of the present invention is compared with that obtained using a thin metal wire which is elongated longitudinally (in the vertical direction) in FIGS. 10(*a*) and 10(*b*). It will be understood that a region $S_1$ subjected to a breaking function of the thin metal wire 42 shown in FIG. 10(*a*) is far narrower than $S_2$ which is subjected to a breaking function of the longitudinally elongated thin metal wire shown in FIG. 10(*b*).

FIG. 10(*c*) is a side view of the thin metal wire shown in FIG. 10(*b*). In FIGS. 10(*b*) and 10(*c*), a reference numeral 201 represents a hole for fitting electrodes which is formed in a base rock 202, a pair of electrodes 203 are fitted in this hole 201 for fitting electrodes and a thin metal wire 204 is connected in the vertical direction between these electrodes.

When an expansion force (breaking force) and an area subjected to a breaking function in the fourth embodiment are represented by $F_1$ and $S_1$ respectively, and an expansion force and an area subjected to a breaking function in the case wherein the thin metal wire is disposed vertically are designated by $F_2$ and $S_2$ respectively, breaking pressures $P_1$ and $P_2$ in these cases are expressed by the following equations (1) and (2) respectively:

$$P_1 = F_1/S_1 \quad (2)$$

$$P_2 = F_2/S_2 \quad (3)$$

Since $F_1 = F_2$, we obtain an equation (4) shown below:

$$P_1 = P_2(S_2/S_1) \quad (4)$$

Since $S_2 > S_1$ in the above-mentioned equation (4), a produced breaking pressure is enhanced at a ratio between the areas subjected to breaking functions.

The U-shaped thin metal wire, for example, has half an area subjected to the breaking function and generates an expansion force (breaking force) twice as strong.

Figure 11A:
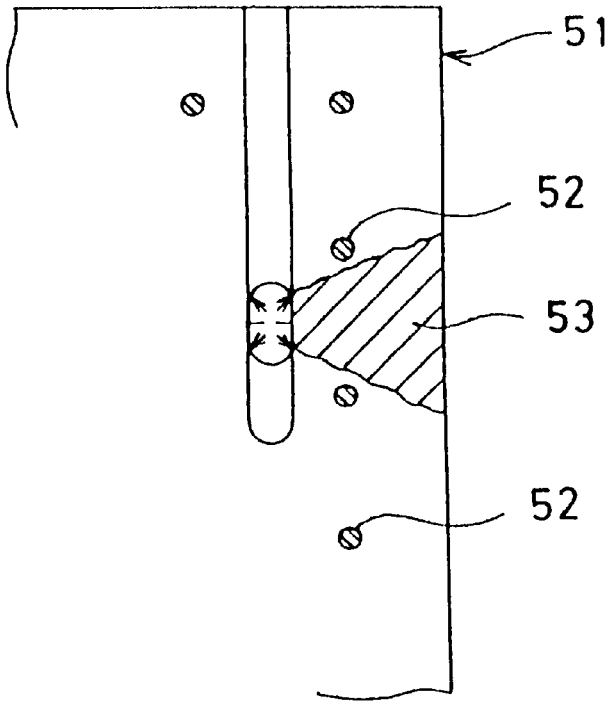
FIGS. 11(*a*) and 11(*b*) are sectional views showing conditions of reinforced concrete walls which are broken using the thin metal wire shown in the fourth embodiment and another thin metal wire disposed in a direction perpendicular thereto.
Figure 11B:
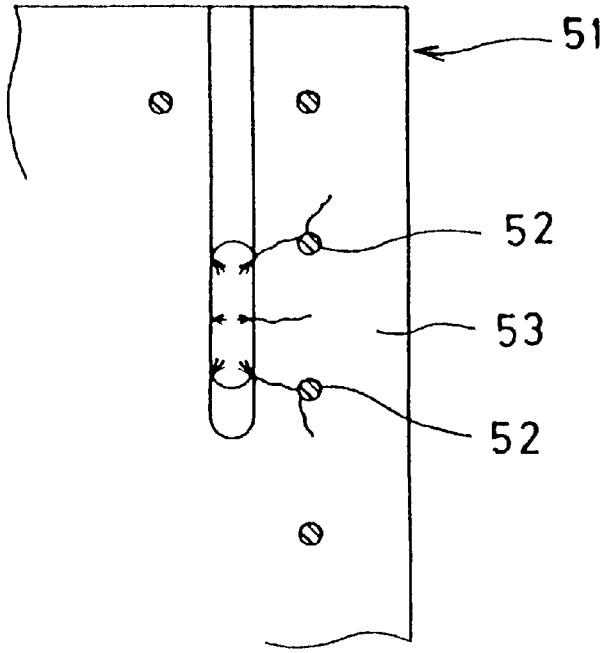

FIGS. 11(*a*) and 11(*b*) illustrate conditions of concrete buildings which are broken with discharge breaking systems using thin metal wires 42 having the shapes described above. FIG. 11(*a*) shows a condition of a concrete building which is destroyed with a discharge breaking system using the thin metal wire selected for the fourth embodiment, whereas FIG. 11(*b*) shows a condition of a concrete building which is destroyed with a discharge breaking system using the thin metal wire disposed vertically.

As seen from FIG. 11(*a*), a thin metal wire which has a function to break a narrow area produces a high expansion pressure and allows secure breakage of concrete 53 while avoiding reinforcement 52, thereby being capable of exposing the reinforcement 52.

On the other hand, a thin metal wire which has a function to break a wide area produces a low expansion pressure and an expansion force which acts also on the reinforcement 52 but does not act sufficiently on concrete 53, thereby being incapable of allowing secure breakage of the concrete 53.

Though the lower ends of the electrodes 41 between which the thin metal wire 42 is connected are disposed nearly at the same horizontal level in the foregoing description, the lower ends of the electrodes 42 may of course be deviated from each other within such a range as not to hinder a breaking function.

Figure 12:
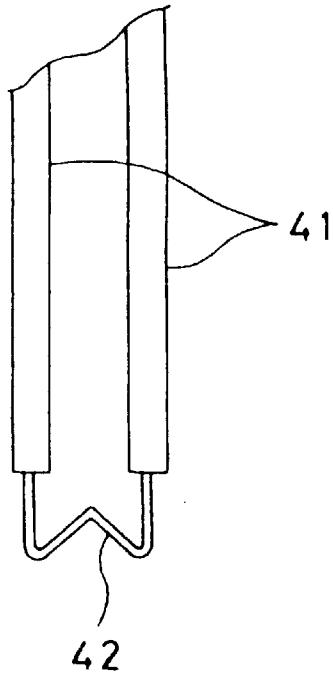
FIG. 12 is a front view showing main members in a modification of the thin metal wire used in the fourth embodiment.
Figure 13:
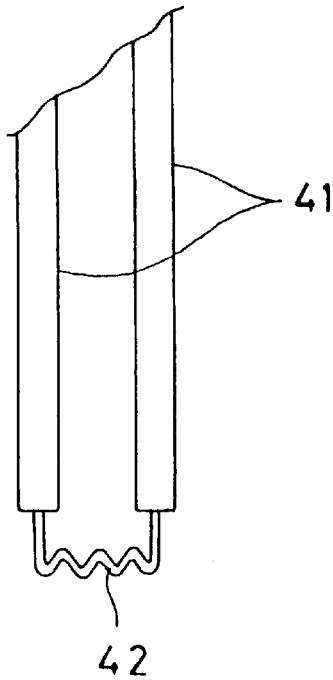
FIG. 13 is a front view showing main members in another modification of the thin metal wire used in the fourth embodiment.
Figure 14:
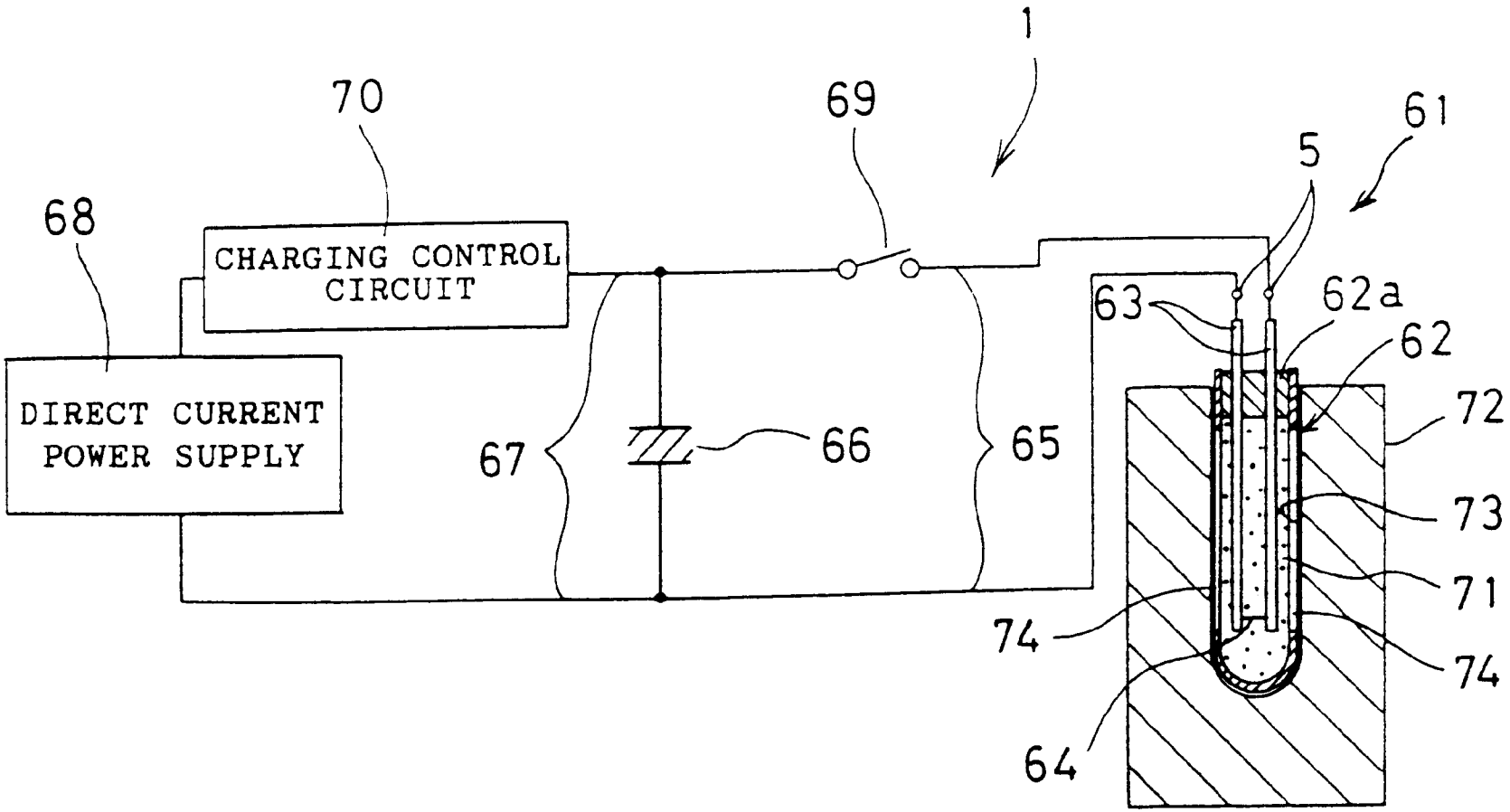
FIG. 14 is a sectional view showing an overall configuration of a fifth embodiment of the discharge breaking system according to the present invention.
Figure 15:
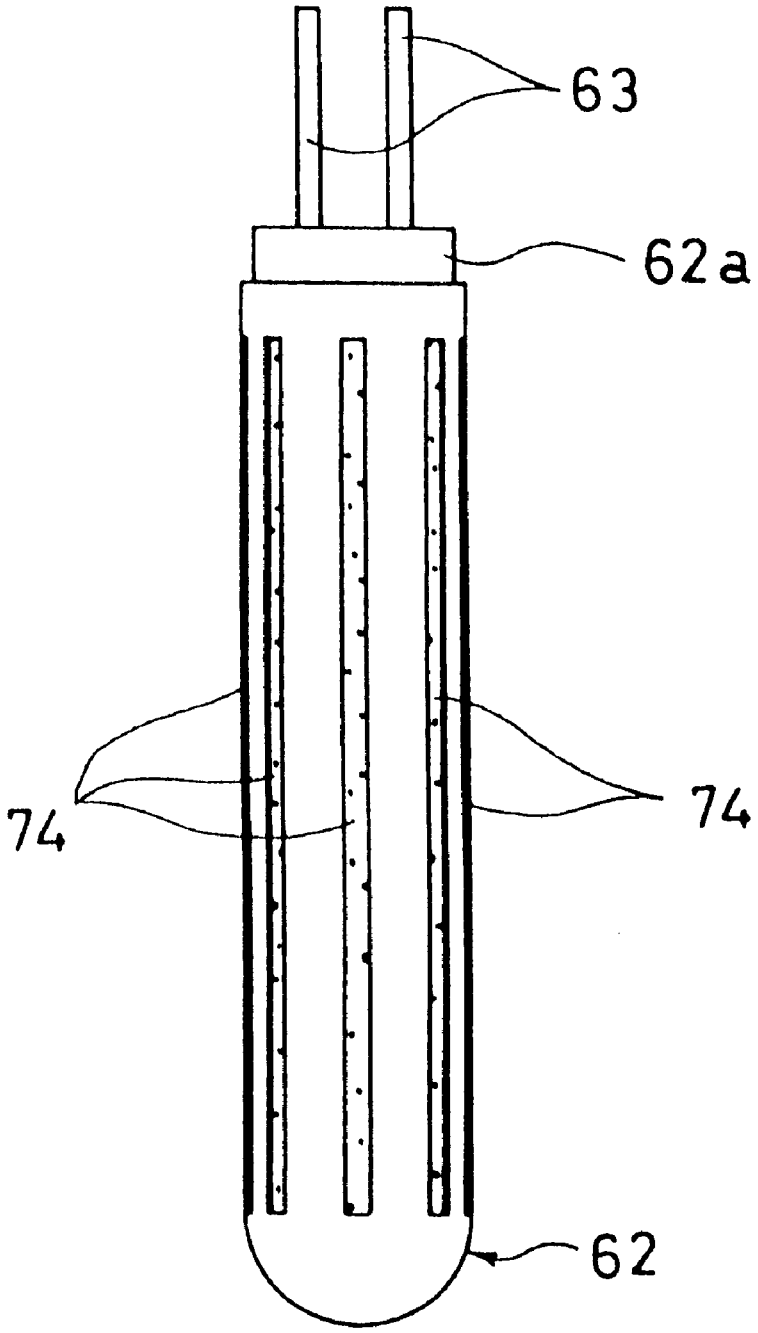
FIG. 15 is a side view of a cylindrical container used in the fifth embodiment.
Figure 16:
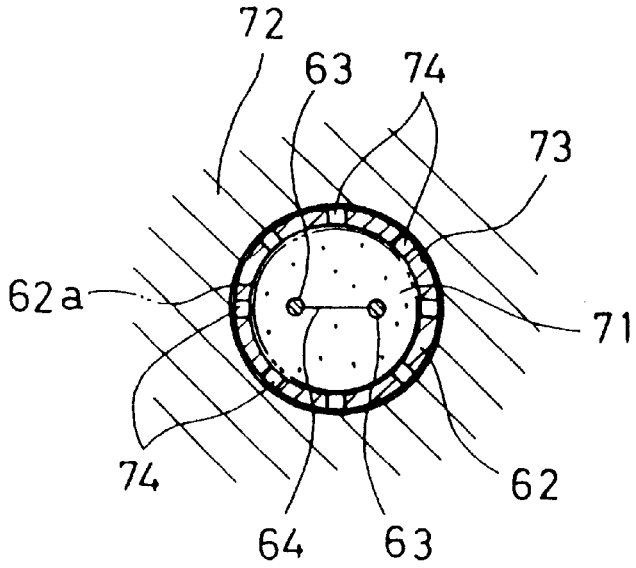
FIG. 16 is a cross-sectional view showing the cylindrical container used in the fifth embodiment.

Though the thin metal wire 42 has the U-shape in the foregoing description, it is not limited to this shape, but the W-shape or the corrugated shape shown in FIGS. 12 and 13, for example, may be selected for the thin metal wire 42.

The fourth embodiment which uses the curved thin metal wire connected between the electrodes allows an expansion force produced by electric discharge to function within a region which is narrower than that obtained with a straight thin metal wire, thereby being capable of enhancing an expansion pressure.

Now, a fifth embodiment of the present invention will be described with reference to FIGS. 14 through 19.

A discharge breaking system 61 preferred as the fifth embodiment comprises: a cylindrical container 62 which is made of synthetic resin, glass, plastic rubber (synthetic rubber) or waterproofed paper and filled with a breaking substance (a substance for transmitting a pressure); a pair of electrodes 63 which pass through a sealing stopper 62*a* into the cylindrical container 62; a thin metal wire 64 which is connected between ends of the electrodes 63 and is made of copper or aluminum; a capacitor 66 which is connected to the electrodes 63 through discharging electric wires 65, and a high voltage DC power supply (power supply unit) 68 which is connected to the capacitor 66 through charging electric wires 67.

Needless to say, a discharging switch 69 is interposed in the course of the discharging electric wires 65 and a charging control circuit 70 comprising a charging switch is interposed in the course of the charging electric wires 67.

A fluidized self-hardening substance (for example, a liquid resin or bonding agent) 71 which is solidified after lapse of a predetermined time is filled in the cylindrical container 62. Needless to say, the thin metal wire 64 connected between the ends of the electrodes 64 is disposed in the self-hardening substance 71. The thin metal wire 64 is soldered or caulked to the electrodes 63. The cylindrical container 62 is used in a condition where it is fitted in a hole 73 formed in an object to be fractured 72.

For leading an expansion force produced by volumetric swelling of the thin metal wire 64 in definite outward directions, eight elongated slits (an example of breaking openings) 74 are formed at intervals of 45 degrees in a circumference of a side wall of the cylindrical container 62.

Now, description will be made of a method for manufacturing the discharge breaking system 61 described above, or more concretely a charging method for the breaking substance.

Figure 18:
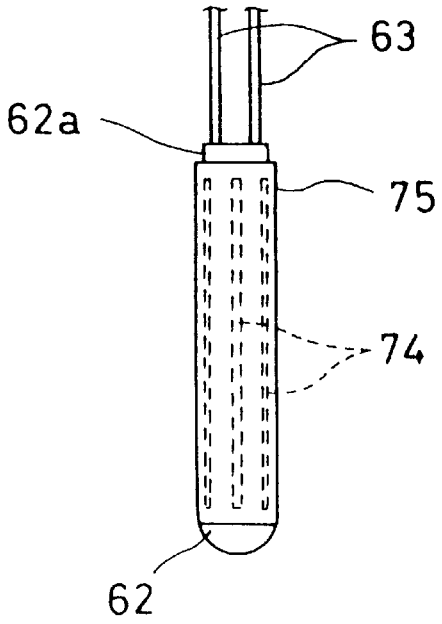
FIG. 18 is a side view visualizing a method for manufacturing the cylindrical container used in the fifth embodiment.

First, the slits 74 are sheathed by covering the cylindrical container 62 with a sheath member 75 such as a tape as shown in FIG. 18.

Then, a fluidized self-hardening substance 71 is poured into the cylindrical container 62 and the electrodes 63 having the thin metal wire 64 connected between the tip ends thereof are inserted into the cylindrical container 62.

In this condition, the thin metal wire 64 and the electrodes 63 are, needless to say, submerged in the self-hardening substance 71. Subsequently, an aperture of the cylindrical container 62 is closed with the sealing stopper 62*a* through which the electrodes 63 pass.

Figure 19:
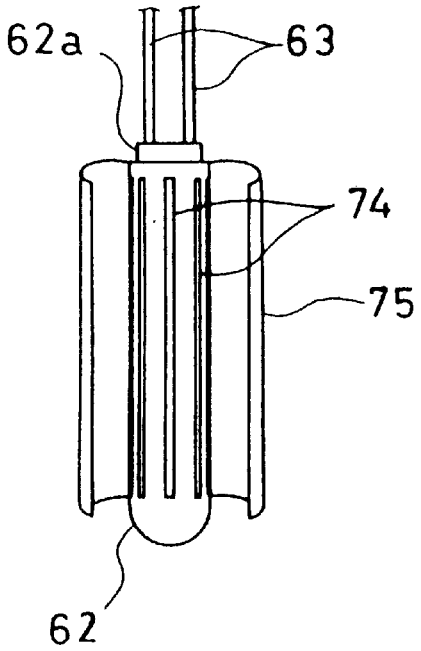
FIG. 19 is a side view visualizing the method for manufacturing the cylindrical container used in the fifth embodiment.

After the fluidized self-hardening substance 71 is solidified, the cylindrical container 62 which is charged with the self-hardening substance 71 can be obtained by peeling off the sheath member 75 from the cylindrical container 62 as shown in FIG. 19.

For breaking the object to be fractured 72 using the discharge breaking system 61 described above, the cylindrical container 62 in which the electrodes 63 are inserted and the self-hardening substance 71 is charged is fitted in the hole 73 formed in the object to be fractured 72.

Figure 17:
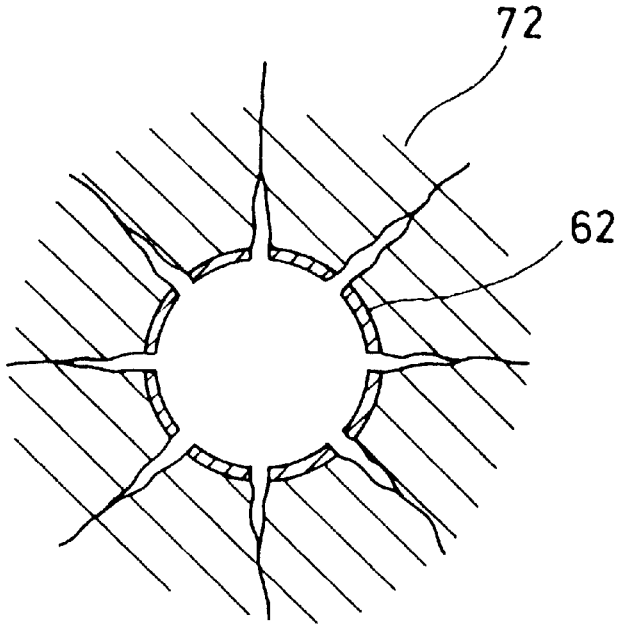
FIG. 17 is a cross-sectional view illustrating a broken condition in the fifth embodiment.

Then, the discharging wires 65 is connected to the electrodes 63, whereafter the discharging switch 69 is turned on to supply electric energy accumulated in the capacitor 66 at a stroke to the thin metal wire 64. The thin metal wire 64 is abruptly fused and vaporized, and the self-hardening substance 71 is vaporized almost simultaneously, whereby its volume is abruptly swollen to generate an expansion force or a breaking force. The generated expansion force is led to the slits 74 and breaks or embrittles the object to be fractured 72 in predetermined directions as shown in FIG. 17.

The fifth embodiment in which the slits 74 are formed in the cylindrical container 62 for leading the expansion force to the slits 74 as described above makes it possible to carry out a breaking work with a high efficiency since it is capable of preventing the sealing stopper 72*a* from being blown out, thereby preventing the expansion force from escaping through the aperture of the cylindrical container 62.

Further, the fifth embodiment facilitates setting of breaking directions since it permits freely selecting intervals and locations for the slits 74 dependently on breaking directions. Accordingly, a number of the slits 74 is not limited to 8 and can be enlarged or reduced as occasion demands, and intervals thereof may not always be equal to one another.

In addition, pouring of the self-hardening substance 71 into the cylindrical container 62 is not limited to the manner described above.

Figure 20:
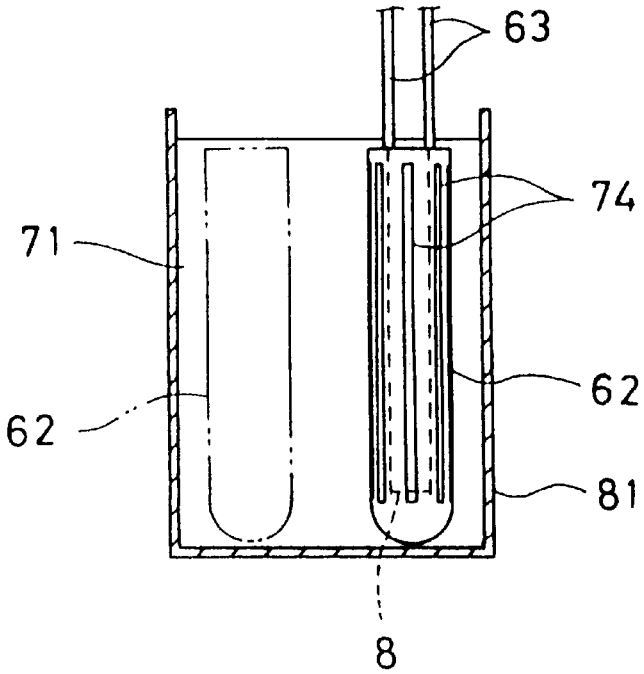
FIG. 20 is a side view visualizing another method for manufacturing the cylindrical container used in the fifth embodiment.

For example, the pair of electrodes 63 having the thin metal wire 64 are first inserted, as shown in FIG. 20, into the cylindrical container 62 in which the slits 74 are formed. Then the aperture of the cylindrical container 62 is closed with the sealing stopper 62*a* having the electrodes 64 passing therethrough.

Figure 21:
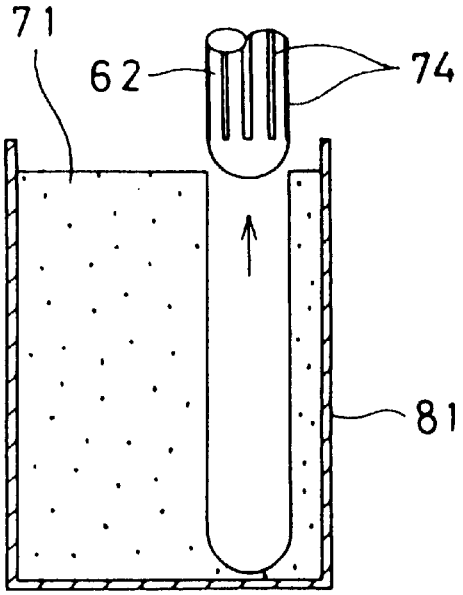
FIG. 21 is a side view visualizing still another method for manufacturing the cylindrical container used in the fifth embodiment.
Figure 22:
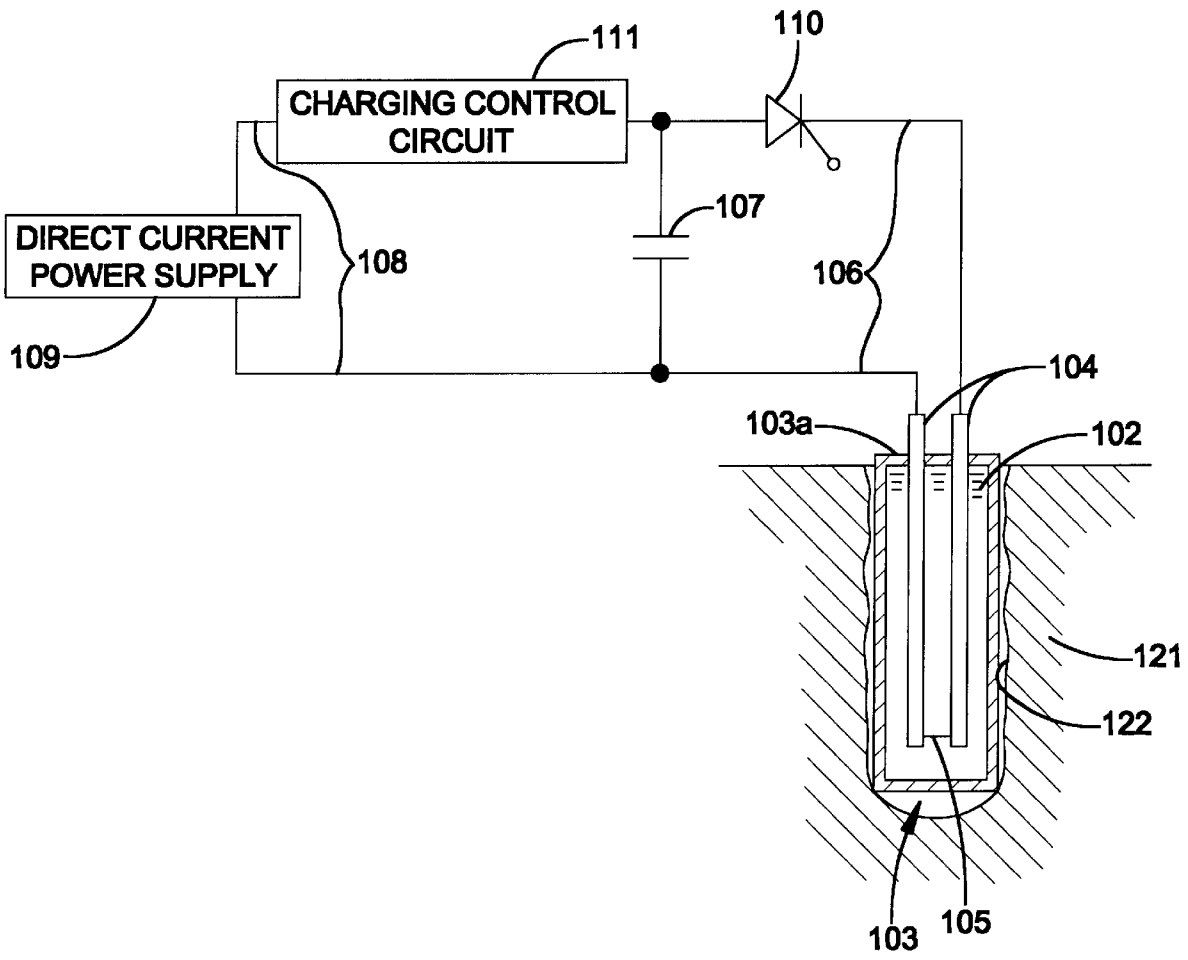
FIG.22 PRIOR ART
FIG. 22 is a sectional view illustrating an overall configuration of a conventional discharge breaking system.

The cylindrical container 62 is submerged into the fluidized self-hardening substance 71 which is filled in a submerging container 81 for allowing the fluidized self-hardening substance 71 to flow into the cylindrical container 62 through the slits 74 (influx of the fluidized self-hardening substance 71 can be facilitated by displacing the cylindrical container 62 rightward, leftward, back and forth). After the fluidized self-hardening substance 71 has been solidified, the cylindrical container 62 is pulled out of the submerging container 81 as shown in FIG. 21.

Though the slits 74 having a predetermined width are formed in the cylindrical container 62 in the fifth embodiment described above, cuts or cracks may be formed so as to form a net-like pattern.

Though the fluidized self-hardening substance 71 is used as the breaking substance which is charged in the cylindrical container 62 in the fifth embodiment described above, the breaking substance is not limited to the fluidized self-hardening substance but may be a substance which is not solidified, for example, water. In such a case, it is unnecessary to peel off the sheath member 75 such as a tape and a generated expansion force can be led to the slits 74 by using, for example, a sheath member having low strength.

INDUSTRIAL APPLICABILITY

As understood from the foregoing description, the discharge breaking method, the discharge breaking system and the manufacturing method for the discharge breaking system are suited for destruction of base rocks at building lands, breakage of rocks and stones, dismantling of concrete buildings, breakage for finishing tunnels, and dismantling and destruction of buildings under water.

What is claimed is:

1. A discharge breaking method comprising the steps of forming a hole for charging a breaking substance in an object to be fractured, inserting a pair of electrodes having a thin metal wire connected between ends thereof into said hole, and supplying electric energy accumulated in a capacitor to said electrodes for fusing and vaporizing said thin metal wire, thereby swelling a volume of said breaking substance and breaking said object to be fractured, wherein the step of charging a breaking substance in an object to be fractured comprises:

disposing and subsequently sealing said breaking substance and said thin metal wire in a container, and closing an opening of said hole by placing a fiber member impregnated with liquid into said opening and tapping a stopper into said fiber member from the outside after said container is disposed in said hole.

2. A discharge breaking system comprising a pair of electrodes having a thin metal wire connected between ends thereof and inserted into a hole which is formed in an object to be fractured and charged with a breaking substance, a capacitor connected to said electrodes, a power supply unit for supplying electricity to said capacitor, a charging control circuit interposed in the course of charging electric wires between said power supply unit and said capacitor, and a discharging switch interposed in the course of discharging electric wires between said pair of electrodes and said capacitor, characterized in that said breaking substance to be charged in said hole is filled in and subsequently sealed by a fiber member impregnated with liquid in a container for accommodating said thin metal wire connected between lower ends of said electrodes, and said discharge breaking system further comprises a stopper tapped into said fiber member for closing an opening of said hole after said container is fitted in said hole during a discharge breaking work.

3. A discharge breaking system comprising a container fitted in a hole formed in an object to be fractured, said container being inserted with a thin metal wire connected between a pair of electrodes and charged with a breaking substance, a capacitor connected to said electrodes, a power supply unit for supplying electricity to said capacitor, a charging control circuit interposed in the course of charging electric wires between said power supply unit and said capacitor, and a discharging switch interposed in the course of discharging electric wires between said pair of electrodes and said capacitor, characterized in that breaking openings are formed in a side wall of said container so as for leading outward in prescribed directions an expansion force generated by fusing and vaporizing said breaking substance.

4. A discharge breaking system according to claim 3 wherein a fluidized self-hardening substance is used as said breaking substance.

5. A method for manufacturing a discharge breaking system having a container fitted in a hole formed in an object to be fractured, the container having a thin metal wire connected between a pair of electrodes and charged with a breaking substance, a capacitor connected to the electrodes, a power supply unit for supplying electricity to the capacitor, a charging control circuit interposed in the course of charging electric wires between the power supply unit and the capacitor, a discharging switch interposed in the course of discharging electric wires between the pair of electrodes and the capacitor, and breaking openings formed in a side wall of the container so as for leading outward in prescribed directions an expansion force generated by fusing and vaporizing the breaking substance, comprising closing the breaking openings with a sheath member, charging fluidized self-hardening substance into the container, and peeling the sheath member off after the self-hardening substance is solidified.

6. A method for manufacturing a discharge breaking system having a container fitted in a hole formed in an object to be fractured, the container having a thin metal wire connected between a pair of electrodes and charged with a breaking substance, a capacitor connected to the electrodes, a power supply unit for supplying electricity to the capacitor, a charging control circuit interposed in the course of charging electric wires between the power supply unit and the capacitor, a discharging switch interposed in the course of discharging electric wires between the pair of electrodes and the capacitor, and breaking openings formed in a side wall of the container so as for leading outward in prescribed directions an expansion force generated by fusing and vaporizing the breaking substance, comprising submerging the container in a fluidized self-hardening substance for filling said container with said self-hardening substance and pulling said container out of the surrounding self-hardening substance after said self-hardening substance is solidified.

* * * * *